United States Patent [19]

Gerard et al.

[11] Patent Number: 4,949,563

[45] Date of Patent: Aug. 21, 1990

[54] LOCK FOR DOORS, WINDOWS OR THE LIKE

[75] Inventors: Prevot Gerard, Willerwald; Jumercier Laurent, Phalsbourg; Simoncelli Philippe, Hoff, all of France

[73] Assignee: Ferco International Usine de Ferrures de Batiment S.A.R.L., Sarrebourg, France

[21] Appl. No.: 369,604

[22] Filed: Jun. 21, 1989

[30] Foreign Application Priority Data

Jul. 1, 1988 [FR] France ..... 88 09123

[51] Int. Cl.[5] ..... E05B 47/00

[52] U.S. Cl. ..... 70/279; 70/129; 70/275; 292/144

[58] Field of Search ..... 70/134, 129, 130, 271, 70/275, 279–282; 292/144, 142, 39, 160

[56] References Cited

U.S. PATENT DOCUMENTS

| | | | |
|---|---|---|---|
| 3,086,383 | 4/1963 | Scott | 70/134 X |
| 3,831,408 | 8/1974 | Featherman | 70/279 X |
| 4,058,333 | 11/1977 | Roe et al. | 292/142 X |
| 4,099,752 | 7/1978 | Geringer | 70/279 X |
| 4,135,377 | 1/1979 | Kleefeldt et al. | 70/280 X |
| 4,633,688 | 1/1987 | Bevdat et al. | 70/280 X |
| 4,637,237 | 1/1987 | Witkoski et al. | 70/129 X |
| 4,665,727 | 5/1987 | Uyeda | 70/279 |
| 4,671,086 | 6/1987 | Fogleman et al. | 70/279 X |
| 4,685,316 | 8/1987 | Hicks et al. | 70/279 X |
| 4,691,542 | 9/1987 | Young | 70/279 X |

FOREIGN PATENT DOCUMENTS

| | | |
|---|---|---|
| 2591270 | 12/1987 | France . |
| 8403909 | 10/1984 | World Int. Prop. O. . |

*Primary Examiner*—Robert L. Wolfe
*Assistant Examiner*—Suzanne L. Dino
*Attorney, Agent, or Firm*—Sandler, Greenblum & Bernstein

[57] ABSTRACT

A lock for doors, windows or the like includes a case for housing a control mechanism having an electric motor for actuating at least one control rod acting upon one or a plurality of locking members. To permit the lease or unlocking of the door, window or the like in case of failure of the electric motor, the electric motor is mounted on a movable bracket which is adapted to vertically move in the case and is actuated by a drive which is controlled manually, and/or electrically and-/or electromechanically.

17 Claims, 3 Drawing Sheets

LOCK FOR DOORS, WINDOWS OR THE LIKE

BACKGROUND OF THE INVENTION

1. Field of the Invention

The present invention relates to a lock for doors, windows or the like, which comprises a case housing a control mechanism consisting of electric drive means for actuating at least one control rod acting upon one or a plurality of locking members.

This invention is applicable more particularly in the field of building hardware.

Various types of locks are already known which correspond to the above definition and are characterized in that they comprise a plurality of bolts for locking the door or window leaf at several levels against the dormant frame of the door or window.

2. The Prior Art

Thus, among these known locks, casement-bolts are well-known which comprise essentially at least one control rod extending upwards and/or downwards from a case housing the control mechanism transmitting the movement from a control handle actuated by the user to said control rods. On the other hand, the control rods of these known locks are provided with locking members such as rollers engaging in the locking position registering keepers disposed along the dormant frame.

Casement-locks are also known which are characterized by the addition, in comparison with simple casement-bolts, of a key-actuated member so that a locking bolt can be actuated for locking the control rods in their locking position. Thus, by preventing the movement of these control rods through a direct actuation of the locking members, as would normally be the case if a burglar attempted to break in, these casement-locks provide a higher degree of safety.

Casement-bolts, like casement-locks, are generally fitted in a cavity formed in the front edge of the leaf, the control rods being adapted to slide in a groove formed for this purpose and covered by a face plate.

Among these known devices having a plurality of locking points there are also multi-bolts locks which differ from the above-mentioned locks on the one hand by their position since they are secured to the inner side of the leaf. Under these conditions, the control mechanism as well as the control rods are in many instances concealed by a section member extending substantially throughout the height of the leaf. On the other hand, these multi-bolt locks are provided with locking members consisting for example of a dead bolt movable in a direction at right angles to the front stile of the leaf and parallel thereto.

The advantage offered by these locking devices secured to the inner side of the leaf, in comparison with the aforesaid casement-bolts or casement locks, lies in the fact that the various mechanical component elements are eventually reinforced appreciably, thus improving the leaf strength when a blow is applied thereto.

Recent technical improvements made in both electronic and electro-mechanical fields permit of motorizing one or the other function of the mechanism of the above-defined locks, so that this function can be remote-controlled.

This feature permitted inter alia of centralizing the control of a plurality of locking devices and eventually of opening and closing a plurality of doors, windows or the like in a building.

Thus, various means have been developed for motorizing these locks. In a first, well-known construction, an electric motor is associated with a lock bolt for locking the control rods in their locked condition. Simultaneously, resilient return means have been incorporated in the control mechanism for causing the automatic translation of said control rods to their locking position when closing the leaf.

In fact, this arrangement is a rather hybrid one since only the locking of the door, window or the like can be obtained automatically, the unlocking thereof requiring a manual intervention.

Another known proposition consists of a lock of which only the locking members are motor-driven.

This type of construction, though permitting the remote control of both the locking and unlocking of the door, window or the like, involves the use of as many motor means as there are locking members. Thus, these locking means are particularly expensive to manufacture, and furthermore the failure of a single motor would prevent the opening of the door or window.

Another known solution consisted in actuating the control rods by means of a single electric motor, the control rods being locked in their operative or locking position by electromechanical or electronic means.

In all the above-mentioned solutions the locks are constructions so complicated that the failure of a single mechanical, electromechanical or electronic element will prevent the locking or unlocking of the door, window or the like, Now, one can imagine that in case of fire or other disaster, the failure of such locks would cause people to be trapped in the house and not rescued in time.

A first attempt to palliate this inconvenience consisted in doubling the electric control means by using manual control devices. The obvious consequence of..-this solution was an increased complexity of the equipment, without inasmuch providing a satisfactory answer to the question. In fact, a risk was still pending, in that the failure of the electric motor means might be followed by a failure of a mechanical component element as a consequence, for instance, of the distortion of the door, window or the like under the pressure of the crowd trying to reach the exit. In this case, no efficient and simple solution is available.

SUMMARY OF THE INVENTION

It is the primary object of the present invention to avoid the inconveniences set forth hereinabove by providing a locking system comprising electric motors associated with the control rods and constituting in fact an auxiliary or secondary control means, said motors being subordinate in turn to a main control member without allowing inasmuch the momentary condition of operation of one control means to affect the momentary condition of operation of the other control means.

For this purpose, the present invention relates to a lock for a door, window or the like, which comprises a case housing a control mechanism consisting of electric motor means adapted to actuate at least one control rod for moving one or a plurality of locking members, said electric motor means being mounted on a movable support adapted to move vertically in the case and responsive to drive means controlled manually and/or electromechanically and/or electronically.

The advantages resulting from the construction according to the present invention consist essentially in that the control rods, in case of failure of the electric motor drive, are unlocked by moving vertically the complete control mechanism, By coupling said electric motor means with said control rods, the control rods will accomplish the same stroke and thus retract the locking members with respect to the keepers provided on the dormant frame. To sum up, the substitute means for controlling the control rods are of the direct type, thus avoiding the risk of failure in intermediate transmission means.

Other features and advantages of the present invention will appear as the following description proceeds with reference to the attached drawings.

THE DRAWINGS

FIG. 1 is a diagrammatic elevational view of a lock according to the present invention, FIG. 2 is a diagrammatic elevational view of a locking member co-operating with a control rod in the lock of FIG. 1, and FIG. 3 is a perspective view of the lock according to the present invention.

DESCRIPTION OF THE PREFERRED EMBODIMENT

The essential feature of the lock 1 of the present invention is that it operates automatically and can be remote controlled, for example, from a central control board.

This lock 1 may be either fitted in a cavity formed in the front edge of a leaf, or secured to the inner side thereof, as illustrated more particularly by way of example in the accompanying drawings.

Thus, the lock 1 according to the present invention comprises a case 2 in which a control mechanism 3 adapted to actuate at least one control rod 4, 5 extending upwards and/or downwards from the mechanism is mounted. The configuration of case 2 is subordinate to the specific mounting of the lock. If the lock is fitted in the front edge of the leaf, its dimensions will be reduced within possible limits to avoid a too deep or wide cut in the leaf and therefore its impairment.

Figure 1:
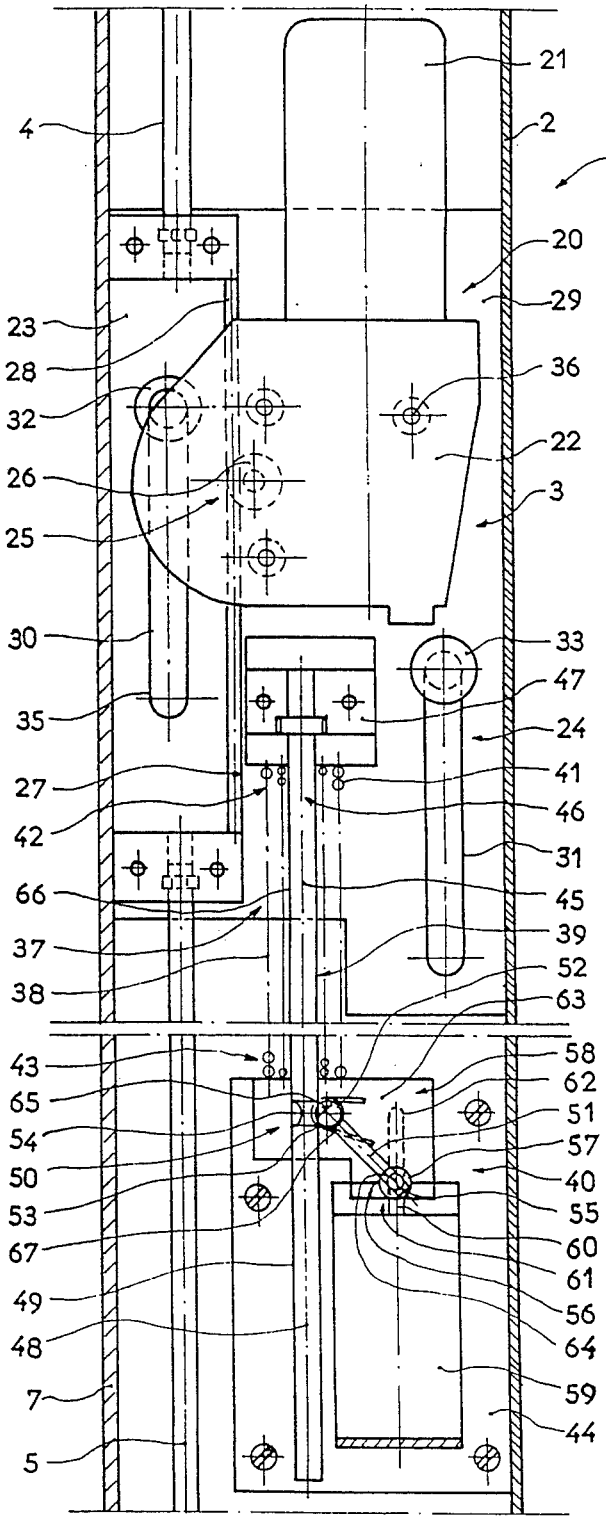

When the device is secured to the main surface of the leaf, as shown in FIG. 1, the case 2 may extend throughout the height of the leaf. Under these conditions, this case 2 has the shape and appearance of a section member covering and concealing simultaneously the driving mechanism 3 and the control rods 4, 5.

These control rods 4, 5 are adapted to actuate a plurality of locking members 6 disposed at spaced intervals above and/or beneath the control mechanism 3 and co-operating, in their locking position, with keepers (not shown) provided on the dormant frame of the door or window.

The locking members 6 may consist of vertically movable rollers or the like, secured to control rods 4, 5 and projecting from a face plate 7 secured to the front edge either of the leaf or of the section-member or case 2.

Figure 2:
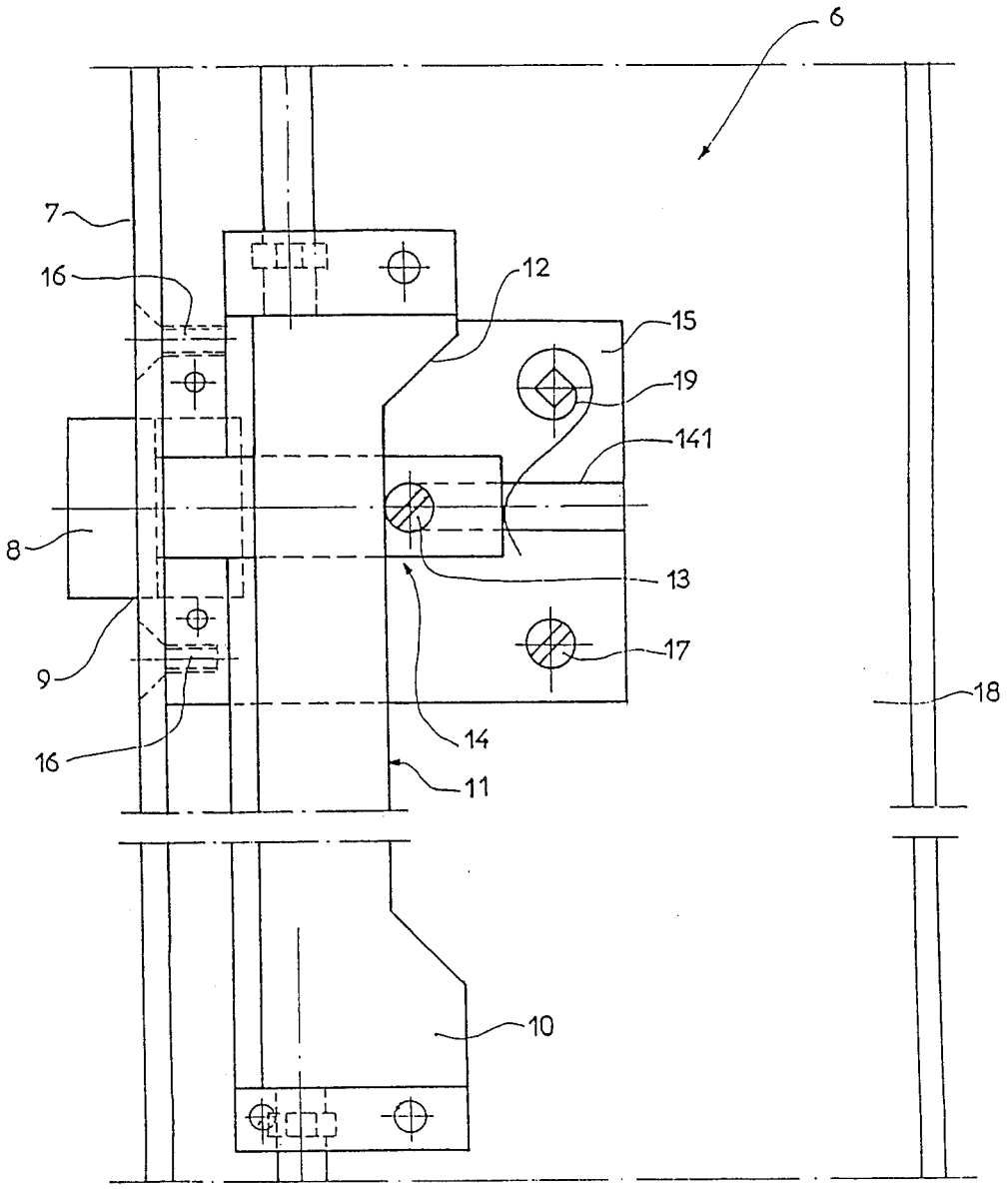
Figure 3:
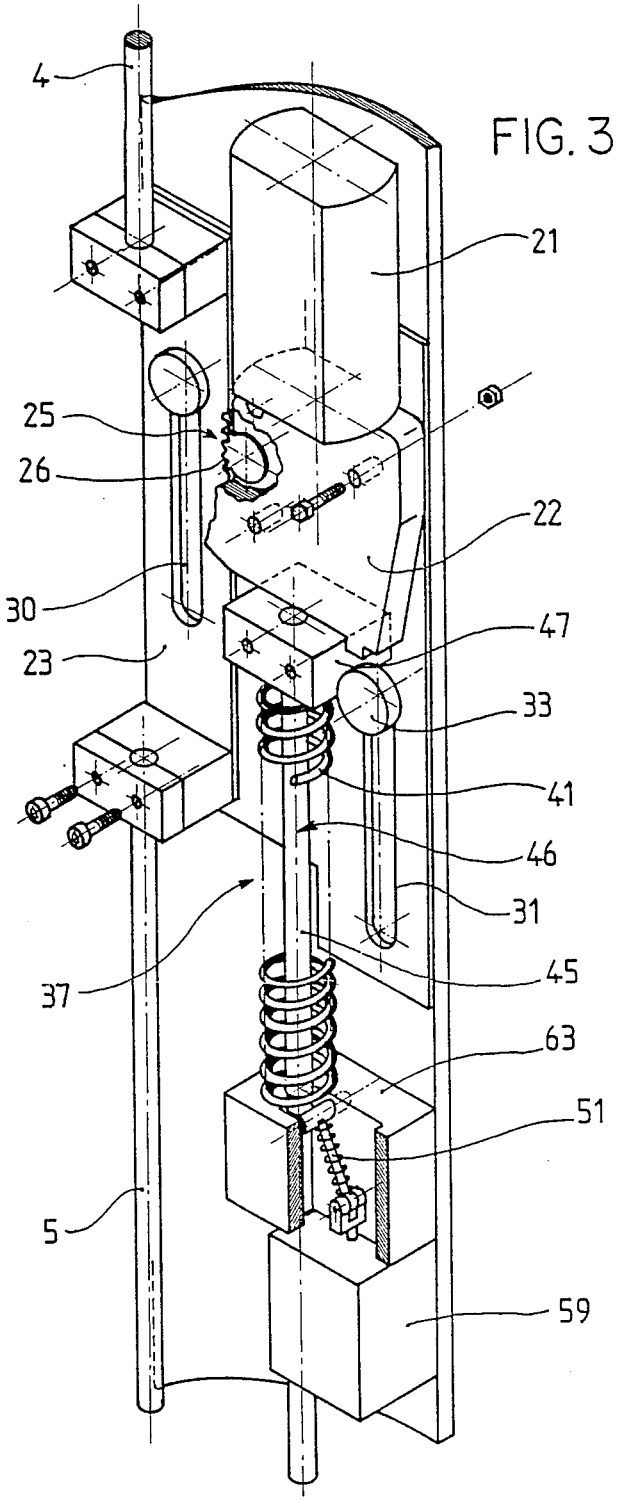

According to a modified form of embodiment illustrated in FIG. 2 the locking members 6 comprise a half-turn bolt 8 movable in a direction at right angles to the leaf and projecting from face plate 7 through an aperture 9 so as to engage a keeper disposed on the dormant frame. When unlocking the device, the half-turn bolt 8 can retract into the case 2.

By way of example, this half-turn bolt 8 is controlled by means of control rods 4, 5 with the assistance of an intermediate bridge member 10 rigidly connected to said rods and having formed in its rear edge 11 a notch 12 adapted to cooperate with one end of a pin 13 extending through the shank 14 of half-turn bolt 8. The other end of pin 13 engages an elongated aperture 141 formed in one wall of a case 15 for housing and guiding said half-turn bolt 8.

The case 15 is secured to the face plate 7 by means of fastening members 16 such as screws, rivets or the like. In the appliqué solution the assembly comprising the case 15 and the leaf can be reinforced by providing additional fastening members 17 engaging the inner wall 18 of said leaf or a reinforcing plate (not shown) secured to this wall.

Preferably, the shank 14 of half-turn bolt 8 co-operates with resilient return means 19 constantly urging the bolt to its operative position, as shown in FIG. 2. Furthermore, with this arrangement the door, window or the like can be closed even if the control rods 4, 5 have been actuated beforehand and are in their locking position.

The mechanism 3 controlling the lock 1 comprises preferably electric motor means 20 adapted to drive the control rods 4, 5 to their locking and unlocking positions corresponding to the locking or unlocking of the door, window or the like, respectively. The electric motor means 20 is responsive to electric and/or electronic control devices, for example from a remote central control board.

More particularly, the electric motor means 20 incorporated in the lock 1 comprise a motor 21 coupled to drive means 22 engaging the control rods 4, 5 via a bridge member 23 connected to said rods.

According to a specific feature of the present invention, the motor means 20 are mounted on a movable bracket 24 adapted to move vertically in the case 2. The advantage resulting from this specific arrangement is that, in case of failure of one of the electric motors 20, the control rods 4, 5 can nevertheless be actuated manually by moving the bracket 24.

However, this movement of bracket 24 cannot be transmitted to control rods 4, 5 unless the connection 25 between the bridge member 23 and the electric motor means 20 consists, at that time, of a rigid coupling system. In contrast thereto, during the movements of said control rods 4, 5 resulting from the actuation of the electric motor means 20, this connection 25 between drive means 22 and bridge member 23 is necessarily movable.

The solution brought to this problem by the present invention is based on the principle of converting the reaction force exerted by said control rods 4, 5 on said drive means 22 into a force having a horizontal component. In fact, this solution is obtained by using a worm screw 26 as a means for driving the bridge member 23. For this purpose, the bridge member 23 is provided on its inner edge 27 with a rack 28 kept in meshing engagement with said worm screw 26.

According to a preferred form of embodiment, the movable bracket 24 consists of a plate 29 of metal, plastic or other suitable material. This plate 29 has two elongated vertical apertures 30, 31 formed therein on either side of its vertical median line, These apertures 30, 31 are engaged by guiding and retaining trunnions 32, 33 rigidly secured to the inner wall 18 of the leaf or of the armour plate applied. On the other hand, it will be seen that one (32) of said guiding and retaining trunnions also engages an elongated aperture 35 machined in bridge member 23 superimposed to plate 29. Thus, this one trunnion 32 will preserve the positioning and guiding of said bridge member 23 and eventually of said control rods 4, 5 in case 2.

The electric motor means 20 are secured to said plate 29 by means of fastening members 36 such as screws, rivets or the like, of which the number is essentially subordinate to the size and weight of the component elements of the lock 1.

In case of failure either of the means controlling the electric motor means 20, or directly of these electric motor means, the movement of the movable bracket 24 is obtained by drive means 37 controlled in turn manually and/or electronically and/or electromechanically.

Since the above-described safety means consisting essentially of the movable bracket 24 are operated only in case of failure of the lock 1, the drive means 37 consists of a resilient means 38 adapted to move said bracket 24 and control rods 4, 5 from their locking position to their release or unlocking position. For this purpose, the resilient means 38 is kept in a prestressed condition in case 2 by suitable means 39. On the other hand, manual and/or electronic and/or electro-mechanical control means 40 are adapted to release said resilient means 38 when required. More particularly, the resilient means 38 consists of one or a plurality of coil springs 41 engaging with their upper ends 42 the movable bracket 24 and reacting with their lower ends 43 against a control case 44 enclosing the control means 40. The means 39 maintaining the resilient means 38 in its prestressed condition consists of a control lever 45 disposed coaxially to said coil springs 41 and having its upper end 46 connected to a coupling block 47 secured to said plate 29 underneath said electric motor means 20. The upper ends 42 of said coil springs 41 bear against said coupling block 47.

The lower portion 48 of control lever 45 extends into a guide chamber 49 formed in control case 44. According to a preferred form of embodiment the functions of the control members 40 housed in said case 44 consist in keeping this lower portion 48 and eventually the control lever 45 in a lower position inside said guide chamber 49.

For this purpose and according to a specific feature of the present invention, said control members 40 comprise means 50 for preventing said control lever 45 from moving in said control case 44, said means 50 being actuated by manual, electronic or electromagnetic means.

The form of embodiment illustrated in FIG. 1 corresponds more particularly to the combination manual and electromechanical mode of operation.

Thus, said control means 50 consist of a locking arm 51 having a semi-spherical end portion 52 engaging through an aperture in said guiding chamber 49 a circular groove 54 of semi-circular cross-sectional configuration machined in the lower portion 48 of control lever 45. The other end 55 of this locking lever 51 is slidably engaged in an orifice 56 formed in a pin 57 disposed horizontally in a recess 58 of said control case 44. Also enclosed in control case 44 is an electromagnet 59 of which the core 60 is adapted to engage with its upper end 61 the aforesaid pin 57 so as to urge this pin vertically into said recess 58. In this construction, the locking arm 51 is caused to rotate about its semi-spherical end portion 52. The pin 57 is guided in the vertical direction by elongated apertures 62 machined in one or the other inner or outer walls 63 of said control case 44. Also engaged in said elongated apertures 62 are cylindrical trunnions 64 formed integrally at the ends of said pin 57, respectively.

The control lever 45, following an energization of electromagnet 59, is released by machining a flat face 65 on the semi-spherical end portion 52 of locking arm 51, this flat face 65 registering under these conditions with the semicircular groove 54.

According to a particularly advantageous form of embodiment, a pin also formed with the aforesaid flat face may be substituted for said semi-spherical end portion 52 of said locking arm 51. Under these conditions, the ends of this pin are pivotally mounted in the inner and outer walls 63 of control case 44, respectively.

OPERATION

The above-described lock 1 operates as follows :

under normal operating conditions, the direction of rotation of worm screw 26 determines the movement of control rods 4, 5 to bring these rods in the locking or unlocking position, in case of failure, the control rods 4, 5 being in their lower and therefore unlocking position, energizing the electromagnet 59 will release control lever 45, so that the resilient means 38 will urge the movable bracket 24 upwards. As a result, the control rods 4, 5 are released and the door or window is unlocked, the lock is reset by actuating the electric motor means 20 which, by co-operating with bridge member 23, will move the movable bracket 24 to its initial position while compressing coil springs 41, at the end of this movement, the locking arm 51 and notably its semi-spherical end portion 52 engages the groove 54 formed in the lower portion 48 of control lever 45, thus holding this control lever against motion in guide chamber 49.

However, due to the presence of the flat face 65 cooperating with the periphery 66 of control lever 45, the locking arm 51 is prevented from resuming its initial position until the groove 54 of said control lever 45 registers with the aperture 53. For this reason, the locking arm 51 is provided with resilient return means 67 repelling when possible its end 55 and consequently the pin 57 to their lower position in which they bear against the upper end 61 of the core 60 of electromagnet 59.

The means for manually controlling the means 50 holding the control lever 45 in control case 44 may advantageously consist of said pin 57. Under these conditions, one end of said pin 57 extends through the elongated guiding aperture 62 formed in the inner wall of said control case 44 and projects from the inner surface of the lock case 2.

Thus, by moving vertically upwards said gripper end of pin 57, the user can release manually said control lever 44 and eventually unlock the door or window.

Of course, other forms of embodiment of the means 37 for driving the movable bracket 24 may be contemplated. However, the form of embodiment described hereinabove with reference to FIG. 1 is advantageous due to its moderate complexity and therefore its high degree of reliability.

The same applies to the means 39 for holding the resilient means 38 in its prestressed condition in case 2. Thus, as a locking means 50 of control lever 45 in guiding chamber 49, the electromagnet 59 is sufficient. In this case, this electromagnet 59 is rotated through ninety degrees in control case 44 so as to cause its core 60 to engage directly the lower portion 48 of said control lever 45 to be retracted and therefore released.

What is claimed is:

1. A lock for doors, windows, or the like, said lock comprising:

(a) a case;

(b) a control mechanism housed within said case, said control mechanism including at least one control rod for actuating at least one locking member, a motor for moving said at least one control rod, a movable bracket being mounted for vertical movement in said case, said motor being mounted on said movable bracket;

(c) connection means between said at least one control rod and said motor, said connection means forming a substantially rigid connection when said motor is not actuated and a movable connection when said motor is actuated; and (d) drive means for moving said bracket and thereby said at least one control rod when said connection means is a substantially rigid connection.

2. The lock according to claim 1, wherein said connection means includes a bridge member, said bridge member including a rack, a worm screw connected to said motor for meshing with said rack, said worm screw and said rack forming a substantially rigid connection when said motor is not actuated.

3. The lock according to claim 1, wherein said connection means includes a bridge member, said movable bracket comprising a flat plate, said flat plate having formed therein a pair of elongated apertures extending vertically and disposed on either side of its vertical median line, said apertures being engaged by guiding and retaining trunnions fixed to the inner wall of said case, one of said guiding and retaining trunnions coacting with an elongated aperture in said bridge member.

4. The lock according to claim 1, said drive means comprising resilient means adapted to urge said moveable bracket and said at least one control rod from a locking position to an unlocking position, said resilient means being kept in a prestressed condition is said case by prestressing means.

5. The lock according to claim 4, wherein said prestressing means is manual means.

6. The lock according to claim 4, wherein said prestressing means is electromechanical means.

7. The lock according to claim 4, wherein said prestressing means is electronic means.

8. The lock according to claim 4, wherein said resilient means are released by control members housed in a control case, said resilient means comprising at least one coil spring disposed coaxially and engaging said moveable bracket with an upper end, the lower end of said at least one coil spring reacting against said control case.

9. The lock according to claim 4, wherein said resilient means comprises at least one coil spring and is held in a prestressed condition by a control lever housed in a control case which is disposed coaxially to said at least one coil spring and is connected at its upper end to a coupling block secured to a plate located beneath said motor, the lower portion of said control lever being inserted into a guide chamber formed in said control case.

10. The lock according to claim 9, further comprising a movable support actuated by resilient means held is a prestressed condition by said control lever and released by control members comprising means for holding against motion the lower portion of said control lever in a guide chamber formed in said control case, said holding means being actuated by one of manual, electronic means, or electromagnetic means.

11. The lock according to claim 10, wherein said control lever is retained and held against motion at its lower portion in said guide chamber by a locking arm having a semi-spherical end portion engaging through an aperture formed in said guide chamber, a circular groove of semi-spherical configuration in the lower portion of said control lever, the other end of said locking arm being inserted into an orifice formed in a pin extending horizontally in a recess formed in said control case.

12. The lock according to claim 11, said control members being housed in said control case and comprising an electromagnet having a core which engages with its upper end said pin so as to urge said pin vertically into said recess and cause said locking arm to pivot through a predetermined angle about its semi-spherical end portion.

13. The lock according to claim 11, said pin carrying at least one end cylindrical trunnions engaging elongated apertures in the inner and outer wall of said recess.

14. The lock according to claim 11, wherein one of said semi-spherical end portion and said locking arm includes a flat face registering with said circular groove of said control lever when said resilient means is released, said lock further comprising resilient return means co-operating with said end portion for returning said locking arm and said pin to their initial lower portion, after restoring the prestress condition of said resilient means.

15. The lock according to claim 11, comprising a movable bracket actuated by said control lever engaging with its lower portion said guide chamber in said control case, said control lever being held against movement at the level of said lower portion by a locking arm comprising, at one end, a pin engaging through an aperture of said guide chamber said circular groove of semi-spherical cross-sectional contour in said lower portion of said control lever, the pivot pin of said locking arm being further provided with a flat face adapted to co-operate with said aperture formed in said guide chamber for releasing said control lever, said pivot pin comprising trunnions at both ends for pivotal engagement in apertures formed in the inner and outer walls of said control case.

16. The lock according to claim 13, wherein, said pin comprises end trunnions engaged in elongated apertures in said control case, one end of said pin having an extension projecting from said case of said locking device at the inner surface thereof, said one end permitting the manual rotation of said locking arm to permit the manual release of said resilient means.

17. The lock according to claim 1 wherein said motor is an electric motor.

* * * * *